US006141979A

United States Patent [19]

Dunlap

[11] Patent Number: 6,141,979

[45] Date of Patent: Nov. 7, 2000

[54] DUAL HEAT EXCHANGER WHEELS WITH VARIABLE SPEED

[75] Inventor: Steven A. Dunlap, Germantown, Tex.

[73] Assignee: American Standard Inc., Piscataway, N.J.

[21] Appl. No.: 09/443,810

[22] Filed: Nov. 19, 1999

[51] Int. Cl.[7] ..... F25B 49/02

[52] U.S. Cl. ..... 62/176.6; 62/271; 165/8

[58] Field of Search ..... 62/176.6, 176.1, 62/176.5, 173, 94, 271, 216; 165/6, 7, 8, 66, 222

[56] References Cited

U.S. PATENT DOCUMENTS

| | | | |
|---|---|---|---|
| 4,113,004 | 9/1978 | Rush et al. | 165/3 |
| 5,183,098 | 2/1993 | Chagnot | 165/8 |
| 5,548,970 | 8/1996 | Cunningham, Jr. et al. | 62/271 |
| 5,579,647 | 12/1996 | Calton et al. | 62/94 |
| 5,732,562 | 3/1998 | Moratalla | 165/8 X |
| 5,761,923 | 6/1998 | Maeda | 62/271 |
| 5,816,065 | 10/1998 | Maeda | 62/94 X |

OTHER PUBLICATIONS

Airside Alert, "Lexington's Newest Custom Option Total Energy Wheel™ Modules", MCC–96–4, Apr. 22, 1996.

*Primary Examiner*—Harry B. Tanner

*Attorney, Agent, or Firm*—William J. Beres; William O'Driscoll; Peter D. Ferguson

[57] ABSTRACT

A refrigeration system includes a cooling coil and two variable speed heat exchanger wheels (an enthalpy wheel and a sensible wheel) whose rotational speeds are adjusted to control the humidity and temperature of a comfort zone as well as limit the minimum temperature of the cooling coil itself. Each wheel has one half extending across a supply air passageway and another half extending across a return air passageway to transfer heat between the supply air and the return air at a rate that increases with the speed of the wheel. The enthalpy wheel is near the intake and exhaust of outdoor air. The sensible wheel is near a supply air duct and a return air duct associated with the comfort zone. And the cooling coil is disposed in the supply air passageway between the two wheels. In response to a cooling demand, enthalpy wheel speed is adjusted to maintain a minimum coil temperature to avoid coil freeze-up, while sensible wheel speed is adjusted to meet the cooling load. For dehumidification, sensible wheel speed increases to prolong the running time of the system, while enthalpy wheel speed decreases, if necessary, to prevent overcooling the comfort zone.

20 Claims, 2 Drawing Sheets

DUAL HEAT EXCHANGER WHEELS WITH VARIABLE SPEED

BACKGROUND OF THE INVENTION

1. Field of the Invention

The subject invention generally pertains to heat exchanger wheels and more specifically to a pair of heat exchanger wheels that are driven at varying speed to meet a varying cooling and dehumidification demand.

2. Description of Related Art

A comfort zone, such as one or more rooms or an area within a building, is often cooled by a refrigeration system. A typical refrigeration system includes a compressor, a condenser, a flow restriction (e.g., an expansion valve, orifice, etc.), and an evaporator connected in series flow relationship with each other to comprise a closed loop refrigerant-filled circuit. Depending on the arrangement of the system's components, many such systems can be used for both heating and/or cooling. When used for cooling, the evaporator absorbs heat from the comfort zone, while the condenser expels waste heat to atmosphere. Cool supply air for cooling the building can be provided by passing warmer air (e.g., outdoor air, indoor air, or a mixture thereof) directly across the refrigerant-filled evaporator before discharging it into the building. In some systems, the evaporator cools the supply air indirectly by first direct cooling water. The chilled water is then circulated through another heat exchanger, which in turn cools the supply air. Both direct cooling systems and chilled water systems are used in cooling commercial buildings and often take the form of a rooftop unit.

With a rooftop unit, the refrigeration system is primarily contained within a sheetmetal housing installed on the roof of a building. Ductwork passing through the roof conveys cool supply air and return air between the housing and the comfort zone of the building. When the zone calls for cooling, a thermostat signals the refrigeration system to start the compressor, a supply air blower, and possibly a chilled water circulation pump, if used. The blower forcing cool supply air into the comfort zone displaces warmer return air that is exhausted to atmosphere, or sometimes part or all of the return air is recirculated, i.e., recooled and returned to the comfort zone as supply air. When the thermostat indicates that the cooling demand has been met, the refrigeration system typically shuts off. This cycle is repeated as frequently as needed to meet the cooling demand.

When the cooling demand is relatively low in comparison to the cooling capacity of the system, the system only runs briefly between cycles. Unfortunately, such short cycling of the system is especially hard on a compressor and may shorten its life. This is a common problem, as refrigeration systems are generally sized to handle the largest anticipated cooling load of the building. Such an approach to sizing a refrigeration system also tends to be more costly than choosing a system that more closely matches the overall cooling needs.

Although, a refrigeration system typically turns off upon bringing the temperature of the room back down to a set point, in some instances, the humidity of the room may still be uncomfortably high: leaving the room feeling cold and dank. In such cases, the refrigeration system may be run a little longer just to bring the humidity down. However, that can lower the room temperature to an uncomfortable level. So various other methods are used to reduce the humidity.

For example, the supply air can be directed through a drying wheel containing a desiccant (e.g., calcium chloride, lithium chloride, zeolite, etc.) that absorbs moisture from the air. Subsequently, the desiccant is heated to drive the moisture from the desiccant, so the wheel can take on more moisture from the air. The moisture absorbing and drying cycles are typically carried out at the same time at opposite halves of the wheel as the wheel turns. An external heat source (e.g., gas or electric heat) dries one half of the wheel, while supply air passes through the other half. Primary drawbacks of such a system is the initial cost of a desiccant filled wheel and the ongoing energy costs of adding heat to a system whose primary function is cooling.

Another dehumidification system involves a reheat coil downstream of the cooling coil. The cooling coil brings the temperature of the supply air below its dew point to condense moisture from the air. The reheat coil subsequently raises the supply air temperature, so that the comfort zone is not cooled excessively. In some cases, a refrigeration system's condenser can serve as the reheat coil. However, just as with a desiccant system, adding such heat to a cooling system can be inefficient and costly.

In some instances, high humidity can lead to freeze-up of the cooling coil. For example, condensation from incoming air passing through the cooling coil may freeze to the outer surface of the coil. Ice accumulating on the coil obstructs the supply airflow, which reduces the load on the coil. This in turn promotes further buildup of ice.

To prevent freeze-up, the refrigeration system can be periodically turned off, but that can lead to short cycling and all of its related problems. Another solution is to provide a defrost cycle where heat is applied to the coil. However, there are obvious disadvantages of adding heat to a cooling system, as previously explained.

SUMMARY OF THE INVENTION

To overcome the problems of humidity control, coil freeze-up, and short cycling of a refrigeration system, it is a primary object of the invention to provide a first variable speed heat exchanger wheel, or enthalpy wheel, whose speed is adjusted to modulate the temperature of the cooling coil.

Another object of the invention is to use a heat exchanger wheel to help keep the cooling coil fully loaded to avoid freeze-up and short cycling.

Another object is to provide a second variable speed heat exchanger wheel, or sensible wheel, whose speed is adjusted to control the temperature and humidity of a comfort zone.

Yet another object of the invention is to further vary the speed of the enthalpy wheel when needed to help reduce humidity.

A further object of the invention is effectively provide the function of a reheat coil (i.e., reheating supply air) by using the sensible heat exchanger wheel whose source of heat is return air as opposed to heat from a condenser or some other external heat source.

A still further object is to provide a rooftop refrigeration system that can supply 100% outside air while enhancing dehumidification.

Another object is to ensure humidity control by adjusting the speed of two heat exchanger wheels to take full advantage of the latent heat capacity of a cooling coil interposed between the two wheels.

Another object is to adjust the sensible capacity of a refrigeration system to match the cooling load by adjusting the speed of the sensible wheel.

These and other objects of the invention are provided by a novel refrigeration system whose cooling coil is interposed between two variable speed heat exchanger wheels whose speeds are adjusted to control the humidity and temperature of a comfort zone as well as limit the temperature of the cooling coil itself.

DESCRIPTION OF THE PREFERRED EMBODIMENT

Figure 1:
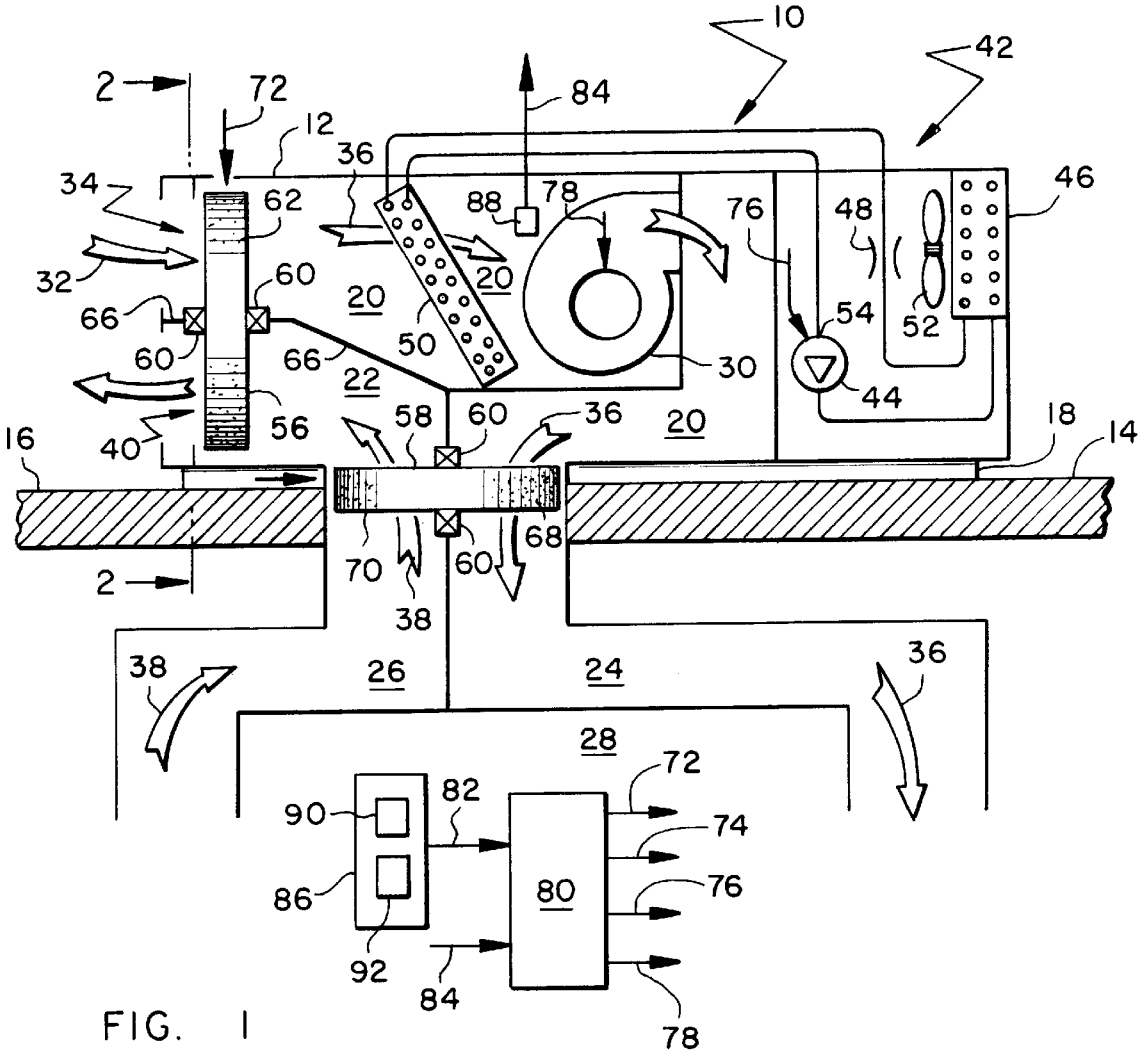
FIG. 1 is a schematic cross-sectional view of a refrigeration system according to one embodiment of the invention.

The refrigeration system of FIG. 1 is a rooftop unit 10 that includes a sheetmetal housing 12 mounted to a rooftop 14 of a building 16 by way of a roof curb 18. The interior of housing 12 defines a supply air passageway 20 and a return air passageway 22 that are respectively coupled to a supply air duct 24 and a return air duct 26 that convey air between unit 10 and a comfort zone, such as a room 28 or area within building 16. A blower 30 disposed in supply air passageway 20 draws in outside air 32 through a housing inlet 34. Upon entering unit 10, air 32 becomes supply air 36, which blower 30 forces out through supply duct 24 and into room 28 for ventilation, heating, cooling, and/or controlling humidity. The forced supply air 36 entering room 28 displaces existing air in the room through return air duct 26. Return air 38 then passes through return air passageway 22 before discharging outside through a housing outlet 40.

To cool and/or dehumidify room 28, unit 10 includes a refrigeration circuit 42 that cools supply air 36. Circuit 42 comprises a refrigerant compressor 44, a condenser 46, a flow restriction 48 (e.g., an expansion valve, orifice, etc.) a cooling heat exchanger 50 (e.g., an evaporator or cooling coil) all of which are connected in series-flow relationship to circulate, compress, expand, heat and cool a refrigerant. In operation, compressor 44 compresses gaseous refrigerant to enter condenser 46 at a relatively high pressure and temperature. A fan 52 blowing ambient outside air across condenser 46 cools and condenses the high-pressure refrigerant, which subsequently passes through flow restriction 48. Upon passing through restriction 48, the refrigerant expands to enter evaporator 50 at a relatively low pressure and temperature, which cools evaporator 50. From there, the refrigerant returns to a suction port 54 of compressor 44 to complete circuit 42. For unit 10, the relatively cold evaporator 50 is disposed in supply air passageway 20 to directly cool supply air 36. However, it should be appreciated by those skilled in the art, that refrigeration circuit 42 could cool supply air 36 more indirectly by way a chilled water coil whose circulating water is cooled by an evaporator of a remote refrigeration circuit. Thus the terms "evaporator," "heat exchanger," and "cooling coil" may be used interchangeably, as they are all well within the scope of the invention.

Figure 2:
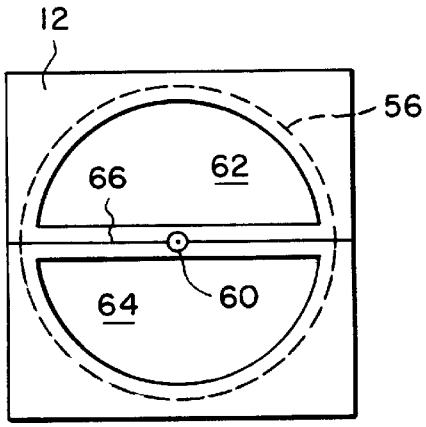
FIG. 2 is a cross-sectional view taken along line 2—2 of FIG. 1.

To help control the degree of cooling or dehumidification, unit 10 also includes two variable speed, air permeable heat exchanger wheels: an enthalpy wheel 56 and a sensible wheel 58. The term "heat exchanger wheel" used herein broadly refers to any rotatable mass adapted to simultaneously absorb and emit heat to its surroundings at different circumferential locations around the mass as it rotates. The heat transfer effectiveness of a wheel can vary depending on numerous parameters that would include, but not be limited to material, porosity, mass, and affinity for water (if any). Both wheels 56 and 58 are rotatably attached to housing 12 by way of bearings 60. Wheel 56 has one portion 62 extending into supply air passageway 20 and a lower portion 64 extending into passageway 22, with both passageways being separated by a dividing panel 66, as shown in FIG. 2. As supply air 36 and return air 38 pass through wheel 56, the warmer airflow heats the other as wheel 56 rotates. The effectiveness of heat transfer generally increases with speed (within reasonable limits), which depend on numerous factors, such as wheel design and airflow temperatures and flow rates. Similar to wheel 56, wheel 58 has portions 68 and 70 extending into passageways 20 and 22 respectively. Both wheels 56 and 58 are driven by a conventional variable speed motor. In this example, motor speed is varied in response to a speed signal such as signal 72 for wheel 56 and signal 74 for wheel 58.

Signals 72 and 74 plus start/stop signals 76 and 78 for compressor 44 and blower 30 respectively are provided by a control 80 in response to feedback signals 82 and 84 from a sensor 86 and a transducer 88 respectively. Sensor 86 schematically represents a device responsive to a thermodynamic demand of comfort zone 28, such as cooling and/or dehumidification. Examples of sensor 86 include, but are not limited to a thermostat 90, a humidistat 92, and a combination thereof. Transducer 88 schematically represents a device responsive to a thermodynamic variable associated with heat exchanger 50, such as evaporator surface temperature, temperature of supply air that has been cooled by evaporator 50, dew point of air in the vicinity of evaporator 50, and temperature or pressure of the refrigerant within circuit 42 (preferably between restriction 48 and compressor inlet 54).

Although the specific control scheme can vary from one embodiment to another, in basic principle control 80 responds to thermostat 86 signaling for cooling by starting compressor 44, blower 30, and fan 52 to lower the temperature of evaporator coil 50. Blower 30 draws relatively warm supply air 36 (i.e., the outside air that has just entered unit 10) across enthalpy wheel 56 and across coil 50, which cools supply air 36. Cool supply air 36 then passes through sensible wheel 58 and enters room 28 by way of supply duct 24. Warmer return air 38 displaced from room 28 passes back across sensible wheel 58 to reheat the cool supply air 36 entering room 28. Return air 38 then exhausts outside upon first passing through enthalpy wheel 56 to precool the incoming supply air 36.

In response to signal 84, control 80 controls the speed of enthalpy wheel 56 to keep the air around coil 50 at a predetermined temperature above freezing, such as 50 degrees Fahrenheit. If the temperature starts falling below the predetermined limit, control 80 decreases the speed of wheel 56 to reduce the rate of heat transfer from supply air 36 (i.e., reduce the precooling of the incoming supply air), and thus increase the load on coil 50. If the temperature of coil 50 becomes too high, control 80 increases the speed of wheel 56 to increase the wheel's precooling of supply air 36.

In response to signal 82, control 80 controls the speed of sensible wheel 58 as an inverse function of the cooling load as sensed by thermostat 90. In other words, control 80 decreases the speed of wheel 58 with an increase in the cooling demand (e.g. actual room temperature minus the desired temperature). When the cooling demand is low, control 80 increases the wheel speed to keep refrigeration circuit 42 more fully loaded. Thus, varying the speed of sensible wheel 58 modulates the cooling load applied to refrigeration circuit 42, which avoids short cycling compressor 44 and avoids higher peak loads that might otherwise be experienced.

Figure 3:
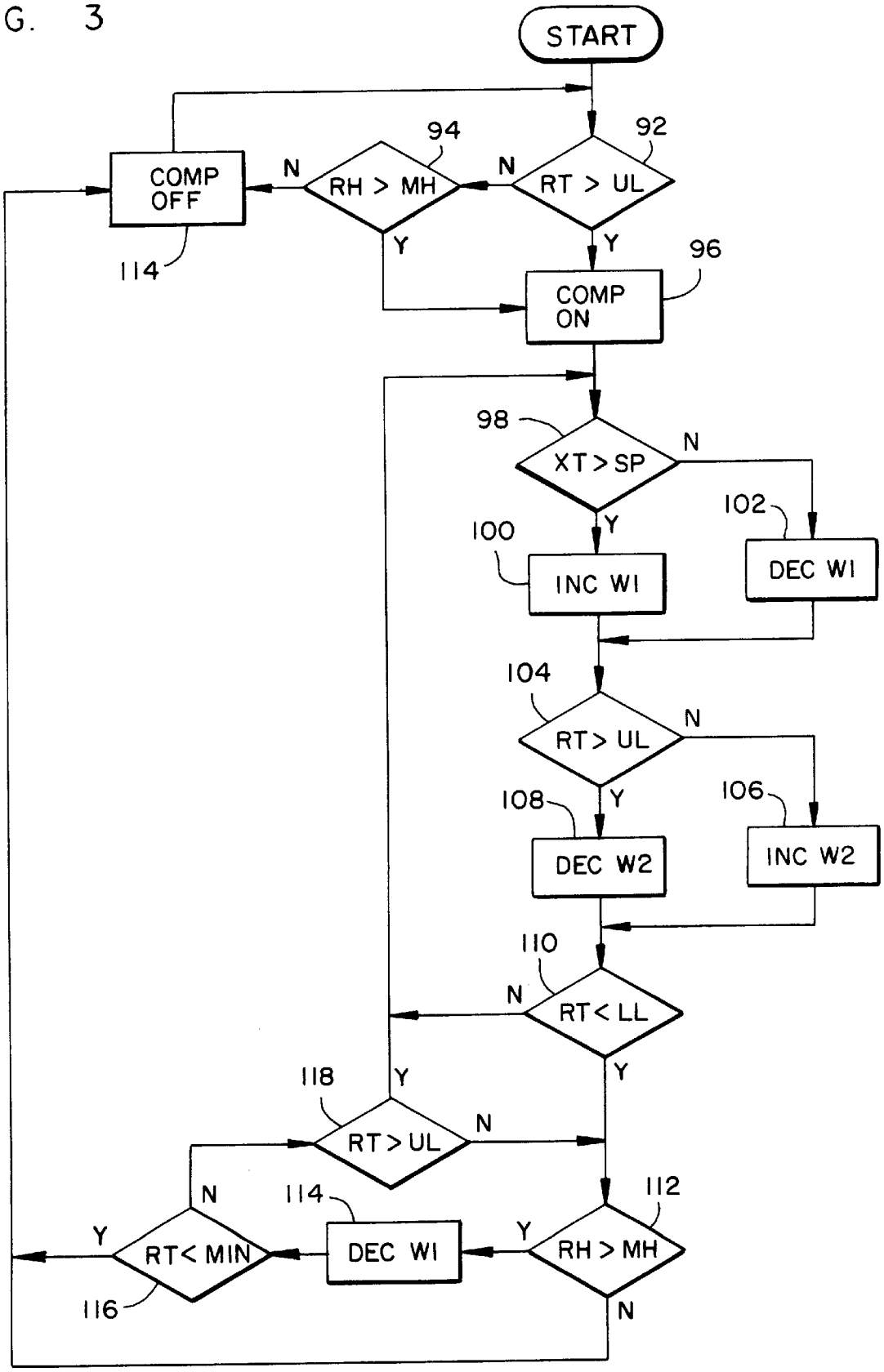
FIG. 3 is a control algorithm illustrating one example of a control scheme for the refrigeration system of FIG. 1.

A more specific control algorithm for control 80 is shown in FIG. 3. Here, decision blocks 92 and 94 determine whether compressor 44 and the related components of circuit 42 should be started. Block 92 determines whether the room temperature RT exceeds an upper temperature limit UL as sensed by thermostat 90, and block 94 determines whether the room humidity RH exceeds a maximum allowable humidity MH, as sensed by humidistat 92. Satisfying either criteria starts compressor 44 by way of control block 96 and output signals 76 and 78.

Decision block 98 determines whether the speed of enthalpy wheel 56 needs to be changed by comparing the heat exchanger temperature XT, as sensed by transducer 98, to a predetermined set point SP. Blocks 100 and 102 respectively increase and decrease the wheel speed accordingly.

Decision block 104 determines whether the speed of sensible wheel 58 needs to be changed by comparing room temperature RT to upper limit UL. Blocks 106 and 108 respectively increase and decrease the wheel speed accordingly. It should be noted that blocks 104, 106 and 108 broadly represent varying the speed of sensible wheel 58 as a function of room temperature and/or cooling load, and encompass proportionally and controllably increasing wheel speed as the room temperature approaches a predetermined target.

Decision block 110 determines whether room 28 still requires cooling by comparing the room temperature RT to a predetermined lower room temperature limit LL (Using a conventional air conditioner as an analogy, upper limit UL would determine when the air conditioner turns on, and the lower limit LL would turn it off, with an operational deadband between UL and LL). If a cooling demand still exists, control loops back to decision block 98 to readjust the speeds of wheels 56 and 58 if necessary.

Once the cooling demand has been satisfied, i.e., the room temperature RT is below the lower limit LL, control shifts to decision block 112 to determine whether there is a need for dehumidification by comparing the room humidity RH to a predetermined maximum humidity MH. If the room humidity is acceptable, control shifts to block 114 to stop compressor 44, blower 30 and fan 52. However, if there is a need for dehumidification, block 114 decreases the speed of enthalpy wheel 56 (to zero if necessary). Everything else continues running, until the room temperature RT drops below a predetermined absolute minimum MIN (even lower than LL), as determined by block 116; the room temperature jumps back up above the upper limit UL (e.g., an outside door or window is opened), as determined by block 118; or the room humidity RH is successfully lowered below the maximum allowable humidity MH, as determined by block 112. If the room temperature RT becomes too cold, block 116 directs the control to block 114 to shut the system down, as the system is unable to reduce the humidity without excessive cooling. If the room temperature RT exceeds the upper LM while in the dehumidification process, block 118 returns control to block 98 to bring the room temperature RT back down.

Although the invention is described with reference to a preferred embodiment, it should be appreciated by those skilled in the art that various modifications are well within the scope of the invention. For example, the algorithm of FIG. 3 can be carried out by discrete electronic components or a microprocessor (e.g., a PLC). It should also be noted that the control algorithm is a simplified illustration to provide a clear understanding of the basic control operation. Various other control blocks, memory, counters, time delays, gain, and dampening can be added for control system stability (e.g., avoid hunting, slow response, etc.) or to suit the specific refrigeration system hardware to which the control is applied. Therefore, the scope of the invention is to be determined by reference to the claims that follow.

I claim:

1. A refrigeration system responsive to a thermodynamic demand of a comfort zone, comprising:

a housing defining a supply air passageway adapted to convey supply air to said comfort zone and defining a return air passageway adapted to convey return air from said comfort zone;

a first heat exchanger wheel extending into said supply air passageway and said return air passageway and being rotatable at a speed that varies to vary a first heat transfer rate between said supply air and said return air, a heat exchanger disposed within said supply air passageway and being adapted to cool said supply air by way of a fluid conveyed by said heat exchanger;

a second heat exchanger wheel extending into said supply air passageway and said return air passageway and being rotatable at an upper speed to provide a second heat transfer rate between said supply air and said return air;

a sensor responsive to said thermodynamic demand of said comfort zone;

a transducer responsive to a thermodynamic variable associated with said heat exchanger; and a control that adjusts said speed of said first heat exchanger wheel in response to said transducer and turns said second heat exchanger wheel on and off in response to said sensor, whereby said second heat exchanger wheel rotates at said upper speed when said second heat exchanger wheel is turned on and is at rest when turned off.

2. The refrigeration system of claim 1, wherein said second heat exchanger wheel is further rotatable at an adjustable speed to vary said second heat transfer rate.

3. The refrigeration system of claim 2, wherein said adjustable speed varies with said thermodynamic demand.

4. The refrigeration system of claim 3, wherein said thermodynamic demand is temperature.

5. The refrigeration system of claim 3, wherein said thermodynamic demand is humidity.

6. The refrigeration system of claim 1, wherein said thermodynamic variable includes at least one of a surface temperature of said heat exchanger, a fluid temperature of said fluid, a pressure of said fluid, and an air temperature of said supply air being cooled by said heat exchanger.

7. The refrigeration system of claim 1, wherein said first heat exchanger wheel is upstream of said second heat exchange wheel with respect to said supply air and wherein said first heat exchanger wheel is downstream of said second heat exchanger wheel with respect to said return air.

8. The refrigeration system of claim 7, wherein said heat exchanger is interposed between said first heat exchanger wheel and said second heat exchanger wheel.

9. The refrigeration system of claim 1, wherein said control adjusts said speed of said first heat exchanger wheel in response to said transducer and said sensor, and wherein said thermodynamic demand is humidity.

10. The refrigeration system of claim 1, further comprising a compressor, a condenser, and a flow restriction connected in series flow relationship with said heat exchanger to comprise a hermetically sealed refrigeration circuit wherein said fluid includes a refrigerant.

11. The refrigeration system of claim 1, wherein said fluid includes chilled water.

12. The refrigeration system of claim 7, wherein said heat exchanger is interposed between said first heat exchanger wheel and said second heat exchanger wheel.

13. A refrigeration system responsive to a thermodynamic demand of a comfort zone, comprising:

a housing defining a supply air passageway adapted to convey supply air to said comfort zone and defining a return air passageway adapted to convey return air from said comfort zone;

a refrigeration compressor;

a condenser;

a flow restriction;

an evaporator connected to said refrigeration compressor, said condenser, and said flow restriction to comprise a hermetically sealed refrigeration circuit that conveys a refrigerant, said heat exchanger being disposed within said supply air passageway and being adapted to cool said supply air by way of said refrigerant;

a first heat exchanger wheel extending into said supply air passageway and said return air passageway and being rotatable at a speed that varies to vary a first heat transfer rate between said supply air and said return air, a second heat exchanger wheel extending into said supply air passageway and said return air passageway and being rotatable at an adjustable speed to vary a second heat transfer rate between said supply air and said return air;

a sensor responsive to said thermodynamic demand of said comfort zone;

a transducer responsive to a thermodynamic variable associated with said evaporator; and a control that adjusts said speed of said first heat exchanger wheel in response to said transducer and varies said adjustable speed of said second heat exchanger wheel in response to said sensor.

14. The refrigeration system of claim 13, wherein said thermodynamic demand is temperature.

15. The refrigeration system of claim 13, wherein said thermodynamic demand is humidity.

16. The refrigeration system of claim 13, wherein said control adjusts said speed of said first heat exchanger wheel in response to said transducer and said sensor, and wherein said thermodynamic demand is humidity.

17. The refrigeration system of claim 13, wherein said first heat exchanger wheel is upstream of said second heat exchange wheel with respect to said supply air and wherein said first heat exchanger wheel is downstream of said second heat exchanger wheel with respect to said return air.

18. A method of controlling a rotational speed of a first heat exchanger wheel and a second heat exchanger wheel that serve a comfort zone being conditioned by an evaporator, comprising;

sensing a thermodynamic demand of said comfort zone;

sensing a thermodynamic variable associated with said evaporator;

varying a first speed of said first heat exchanger wheel as a function of said thermodynamic variable; and varying a second speed of said second heat exchanger as a function of said thermodynamic demand.

19. The method of claim 18, wherein said thermodynamic demand is humidity.

20. The method of claim 18, further comprising varying said first speed of said first heat exchanger wheel as a function of humidity and said thermodynamic variable.

* * * * *